US005462128A

United States Patent [19]

Gray

[11] Patent Number: 5,462,128

[45] Date of Patent: Oct. 31, 1995

[54] CUTTER BIT FOR USE IN DRILLING OPERATIONS

[76] Inventor: Clifford R. Gray, P. O. Box 234, North Beach, Western Australia 6023, Australia

[21] Appl. No.: 161,789

[22] Filed: Dec. 3, 1993

Related U.S. Application Data

[63] Continuation-in-part of Ser. No. 134,386, Oct. 12, 1993, abandoned.

[30] Foreign Application Priority Data

Oct. 20, 1992 [AU] Australia ..... PL5358

[51] Int. Cl.[6] ..... E21B 10/18

[52] U.S. Cl. ..... 175/339; 175/393

[58] Field of Search ..... 175/339, 340, 175/393, 418, 417

[56] References Cited

U.S. PATENT DOCUMENTS

| | | | |
|---|---|---|---|
| 2,692,117 | 10/1954 | Kucera et al. | 175/340 |
| 3,099,324 | 7/1963 | Kucera et al. | 175/339 |
| 3,111,179 | 11/1963 | Albers et al. | 175/393 |
| 4,189,014 | 2/1980 | Allen et al. | 175/339 |
| 4,368,787 | 1/1983 | Messenger | 175/319 |
| 4,711,312 | 12/1987 | Leibee et al. | 175/393 |
| 5,145,017 | 9/1992 | Holster et al. | 175/393 |
| 5,220,966 | 6/1993 | Awdujewski et al. | 175/339 |
| 5,297,643 | 3/1994 | Montgomery, Jr. et al. | 175/393 |

*Primary Examiner*—Ramon S. Britts
*Assistant Examiner*—Frank S. Tsay
*Attorney, Agent, or Firm*—Robert L. Graham

[57] ABSTRACT

Disclosed is a cutter bit (1) for use in drilling operations comprising a body (10) having a top portion (11) and a bottom portion (12), the bottom portion (12) being provided with cutting elements for cutting a formation to which the cutting elements is exposed. Within an outer circumference (13) of the bottom portion (12) of the body (10) there is provided an opening (14) to a first passage (15) through the body (10) to communicate a first zone (20) of a hole located below the bottom portion (12) of the body (10) with a second zone of the hole located above the bottom portion (12) of the body (10).

10 Claims, 5 Drawing Sheets

CUTTER BIT FOR USE IN DRILLING OPERATIONS

This application is a continuation-in-part of Ser. No. 143,386, filed 12th Oct., 1993 now abandoned.

FIELD OF THE INVENTION

This invention relates to cutter bits for use in drilling operations, such as in the oil and gas industry and, in particular, to a bit suitable for alleviating problems associated with running of the cutter bit into a well hole and pulling of the cutter bit from the hole.

BACKGROUND OF THE INVENTION

Conventional cutter bits comprise a generally tubular cutter bit body provided at the bottom end thereof with a plurality of cutters for cutting the well formation. Normally, the cutter bit is forged and provided at its bottom end with three legs having attached to their bottom portions, known as shirt tails, mounting pins for securing cone cutter elements made of a durable material. These cutter elements may be conical and are provided with hard cutting teeth, made, for example, from tungsten carbide, for cutting a formation. Through the centre of the cutter bit body is usually provided a bore through which drilling fluids are delivered at high velocity via three conduits to areas adjacent to the cutters to assist in cutting and cuttings removal. However, the central bore is not itself directly open to the cutting face and, for this reason, a number of problems can arise when a cutter bit is being run into the hole, pulled from the hole or simply being used in cutting operations.

Firstly, it is to be appreciated that the cutter bit body will be in gauge with the walls of the hole and, therefore, as the cutter bit is run into the hole it acts as a piston which compresses material below the bottom end of the cutter bit body. The only relief from the increasing pressures is leakage through zones where the cutter bit body has lesser diameter than the gauge of the hole. However, as these zones only have very small area for flow of cuttings and fluids, the flow is substantially restricted and little pressure relief is obtained. The consequence of such increasing pressures is "surge" or the generation of stresses on the rock formations along the open hole section below the cutter bit. It is known in the oil and gas industry that these stresses or surge pressures cause major damage to weak formations and, more importantly, to productive reservoir sands. In particular, the formation may be damaged by fracturing of the formation beneath the cutter bit during running into the hole. This problem is worsened by increasing running speeds and higher viscosity drilling fluids that cause higher pressure drop across the cutter bit. Clearly, damage to the formation, with consequential reductions in oil and gas recovery, is unacceptable to the industry for cost reasons.

Secondly, upon pulling of the cutter bit from the hole a reverse problem known to the industry as "swabbing" occurs. In the worst cases, swabbing, which results from fluid flow into the reduced pressure area caused by pulling of the cutter bit and drillstring from the hole can cause blowouts which are extremely hazardous. In addition, swabbing may result in contamination of the drilling fluids by formation fluids necessitating costly treatment processes and/or increased drilling fluid cost. Swabbing is most pronounced when the cutter bit or drilling stabilisers are encrusted or packed with formation cuttings. In these cases, it becomes increasingly more difficult to maintain an even hydrostatic pressure on both sides of the cutter bit because the already restricted fluid flow area past the outer circumference of the cutter bit is restricted even further. Other factors that contribute to swabbing include variable viscosity drilling fluids and variation in hole diameter.

A yet further problem with conventional cutters is poor hole cleaning due to a poor efficiency of cuttings removal from the centre of the cutting area at the bottom of the hole. Conventional cutter bits rely on the delivery of drilling fluid to the bottom of the hole for effective hole cleaning. In a typical design, as discussed above, there are three cone cutters and, therefore, three nozzles, each adjacent to each cutter cone, are provided for the jetting of cooling and cleaning fluid to the bottom of the hole. Jetting occurs at high velocity with fluid impacting the bottom of the hole at or near its outer edges close to the hole walls. This action effectively washes the outer zone of the hole to remove cuttings. However, cleaning from the centre of the hole is much less efficient because cuttings become trapped in recesses between the cutters and the bottom end of the cutter bit body. In conventional bits, cutting accumulation in this area can create what is called in the industry bit bailing, where the trapped cuttings restrict the rotation of the cutting cones. Bit bailing has been a major problem in the industry. Thus the overall cleaning and cutting efficiency of the cutter bit is reduced.

SUMMARY OF THE INVENTION

It is therefore the object of the present invention to provide a cutter bit which alleviates the problems discussed above by means of a convenient but ideally inexpensive design.

With this object in view, the present invention provides in a first aspect, a cutter bit for use in drilling operations comprising a body having a top portion and a bottom portion, the bottom portion being connected to cutting means for cutting a hole in a formation to which the cutting means is exposed and the bottom portion having a diameter which defines the circumference of said hole, characterised in that there is provided, within said circumference of said bottom portion of said body, a first opening to a first passage which, in use, communicates a first zone of a hole located below the bottom portion of the body with a second zone of the hole located above the bottom portion of the body. The first passage provides a route for cuttings to escape to the surface of the hole.

Conveniently, the first passage exits the body of the cutter bit adjacent and below a connecting portion, usually a threaded portion, provided on the top portion of the cutter bit body. In addition, it may be found desirable for the first passage to communicate with the second zone through one or more further passages located in the body, for example, below and adjacent the connecting thread portion. The openings to the further passages need not be located at the same level and can be orientated at a variety of different angles corresponding to the trajectory of the first or further passages which ranges between 0° and 90° to the central axis of the cutter bit body.

Conveniently also, the cutter bit may be provided with a plurality of cutting means. Further, the cutter bit body may be provided with one or more supply passages communicating a drilling fluid supply with an opening or openings of the cutter bit body located adjacent to the cutting means for supply of drilling fluids, such as cooling and cleaning fluids, thereto.

Preferably, the first passage opening in the bottom portion of the cutter bit body is located in a recess defined by a plurality cutting means to readily allow transfer of cuttings and fluids from the recess to the second zone of the hole.

In a particularly advantageous embodiment of the invention, flow of cuttings and fluids through the first passage may be assisted by jetting of drilling fluids for example through a nozzle, along the trajectory of the first passage. In one arrangement a second passage and nozzle communicates a filling fluid supply for the cutter bit with the first passage.

BRIEF DESCRIPTION OF THE DRAWINGS

The invention will be better understood from the following description of four embodiments thereof made with reference to the accompanying drawings in which.

DETAILED DESCRIPTION OF THE DRAWINGS

Figure 1:
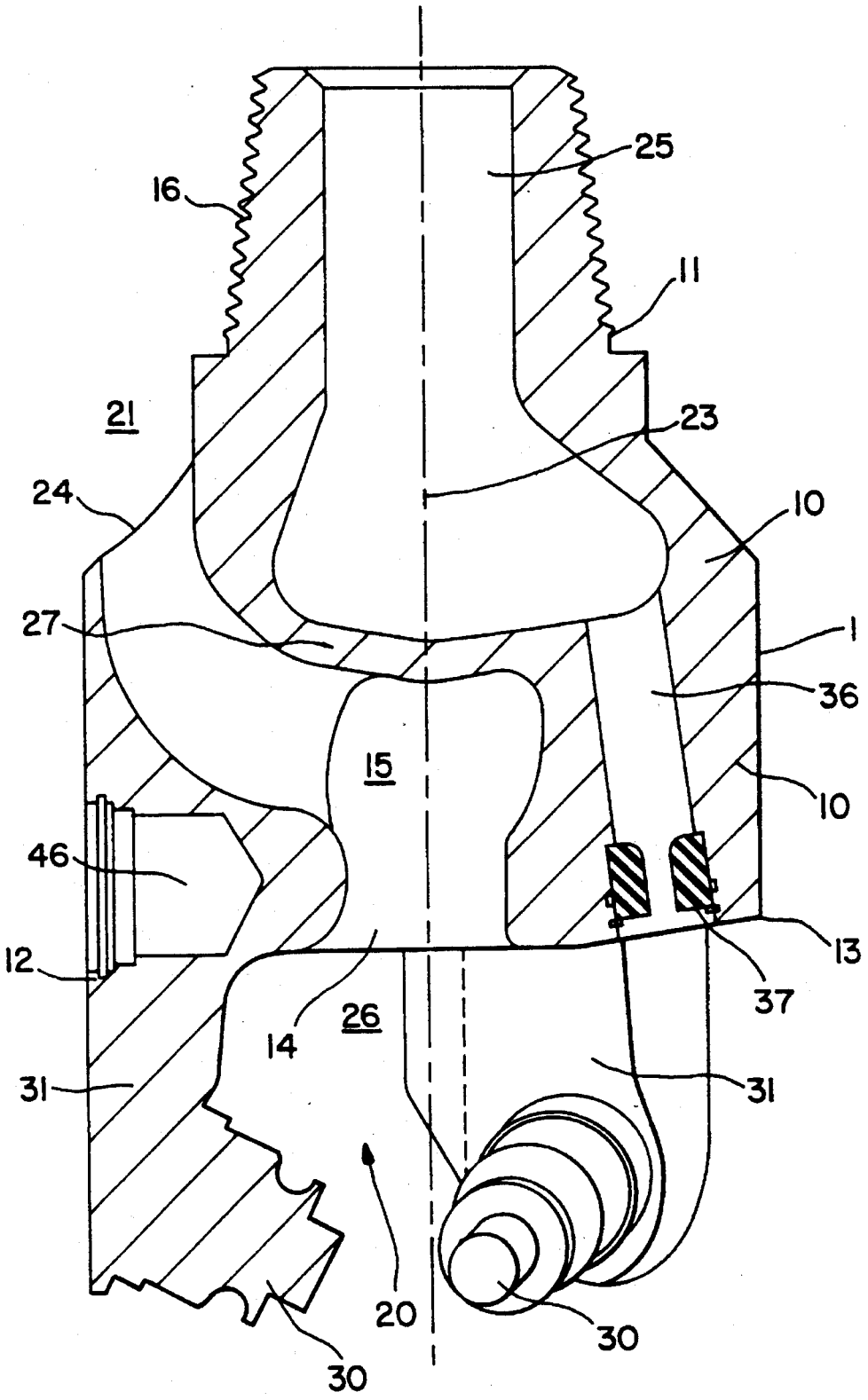
FIG. 1 is a sectional view of a cutter bit made in accordance with a first embodiment of the invention.

In accordance with the broadest aspect of the invention as illustrated in FIG. 1 of the drawings, there is provided a cutter bit 1 for use in drilling operations which comprises a body 10 having a top portion 11 and a bottom portion 12, the bottom portion 12 being provided with cutting means (not shown) for cutting a formation to which the cutter bit is exposed, characterised in that, within an outer circumference 13 of the bottom portion 12 of the body 10, there is provided a first opening 14 to a first passage 15 through the body 10 to communicate a first zone 20 of a hole located below the bottom portion 12 of the body with a second zone 21 of the hole located above the bottom portion 12 of the body. In this way, cuttings and fluids located below the bottom portion of the cutter bit can be transferred from the first zone 20 to the second zone 21.

The cutter bit body 10 above described could be a three cone cutter bit familiar to the drilling industry with the additional provision of the first passage 15. The body 10 is connected to the rest of a drillstring run into the hole by a connecting thread portion 16 provided on the top portion 11 of the body 10. However, other connecting means may also be used.

The body 10 is constructed of a suitable durable material such as steel and the cutting means is comprised, for example, of three rotatable conical cutting elements which are rotatably secured by bearings on pins 30 located on leg members 31 of the cutter bit 1, two of which are shown in FIG. 1. Though not necessary for the practice of the invention, the cutting elements may be fabricated from a hard material such as steel or tungsten carbide and be provided with teeth of the same material to provide a cutting action. The cutting elements are rotatable in response to the revolution of the drillstring and lubricated by oil or grease supplied through port 46, one of which is shown in each of FIGS. 1 to 4.

It may also be readily seen from FIG. 1 that a recess 26 is definable by the cutter elements. During use of the cutter bit 1, cuttings accumulate therein, in the absence of the first passage 15, reducing both the hole cleaning and cutting efficiency of the cutter bit 1. It will also be apparent that if the first passage 15 is not present, the cutter bit 1 will be an almost solid structure acting as a piston with little pressure relief and increasing the problems of surge and swab. These problems are alleviated to an appreciable extent by provision of the first passage 15. It is also desirable, for the purposes of avoiding plugging of the passage 15 with cuttings, to coat the passage 15 with a non-stick material such as teflon.

The trajectory of the passage 15 may also be a matter of some importance in practice. The opening 24 through which cuttings and fluids exit the first passage 15 and enter the second zone 21 may be either parallel or perpendicular to a central axis 23 of the central bore 25 of the cutter bit 1. However, it will be appreciated that if the first passage 15 and its opening 24 to the second zone 21 are perpendicular to the central axis 23, erosion of the hole walls may occur, where jetting of drilling fluids is conducted in accordance with the embodiment described with reference to FIG. 3. This would be undesirable.

However, the trajectory of the first passage 15 is not critical to the cutter bit in its broadest aspect and it is therefore to be understood that the first passage 15 may be oriented at any angle in the range 0° to 90° to the central axis 23. In the embodiment shown, the passage opening 24 is parallel to the central axis 23.

The first passage 15 is separated by wall 27 from the central bore 25 through which drilling fluids travel via conduit 36 and nozzle 37 to a location adjacent the cutting elements.

In the embodiment shown, only one such conduit and nozzle arrangement is shown. However, in a conventional three cone bit it will be understood that there are present three such arrangements. In this way drilling fluids are jetted at high velocity to the cutting face where they assist with cutting operations by cooling and cleaning of the cutter bit 1.

Additionally, it will be seen that, in contrast to the situation where the first passage 15 is absent, the flow of drilling fluids passes through the recess 26 and into the first passage 15 thereby enhancing cuttings removal and hole cleaning. In addition, the restricted flow area of the conventional cutter bit has been increased by the flow area of the first passage 15 thereby increasing pressure relief and allowing a reduction in surge and swab pressures on running into the hole or pulling from the hole of the cutter bit and drillstring.

Figure 2:
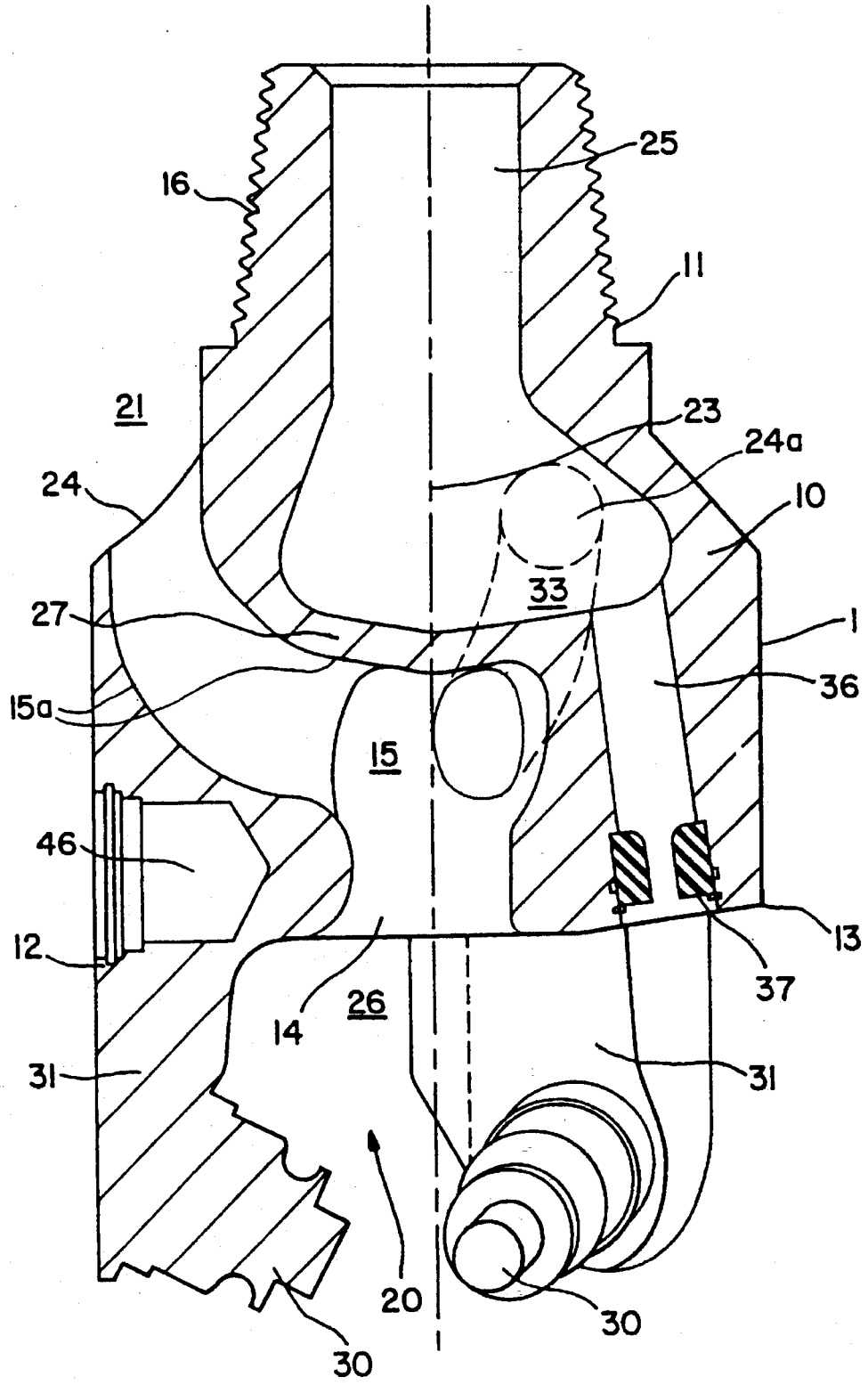
FIG. 2 is a sectional view of a cutter bit made in accordance with a second embodiment of the invention.

FIG. 2 shows a further embodiment of the invention in which the flow area for communication between the first zone 20 and the second zone 21 of the hole is increased still further by the provision of a plurality of openings, two of which openings 24 and 24a are shown. However, any desired number of openings can be employed. Opening 24a communicates with first passage 15 through a further passage 33. This arrangement, by increasing the flow area and improving the distribution of drilling fluid flow into the annulus between the cutter bit body 10 and the hole walls, gives additional assistance in relieving the surge and swab pressure problems. The further passage 33 may likewise be coated with teflon to improve flow properties and reduce the risk of plugging with cuttings. There is no requirement that openings 24 and **24*a* be at the same level of the cutter bit body 10** or at the same trajectory as each other, though this may be found convenient for the purposes of manufacture and uniform flow distribution.

Figure 3:
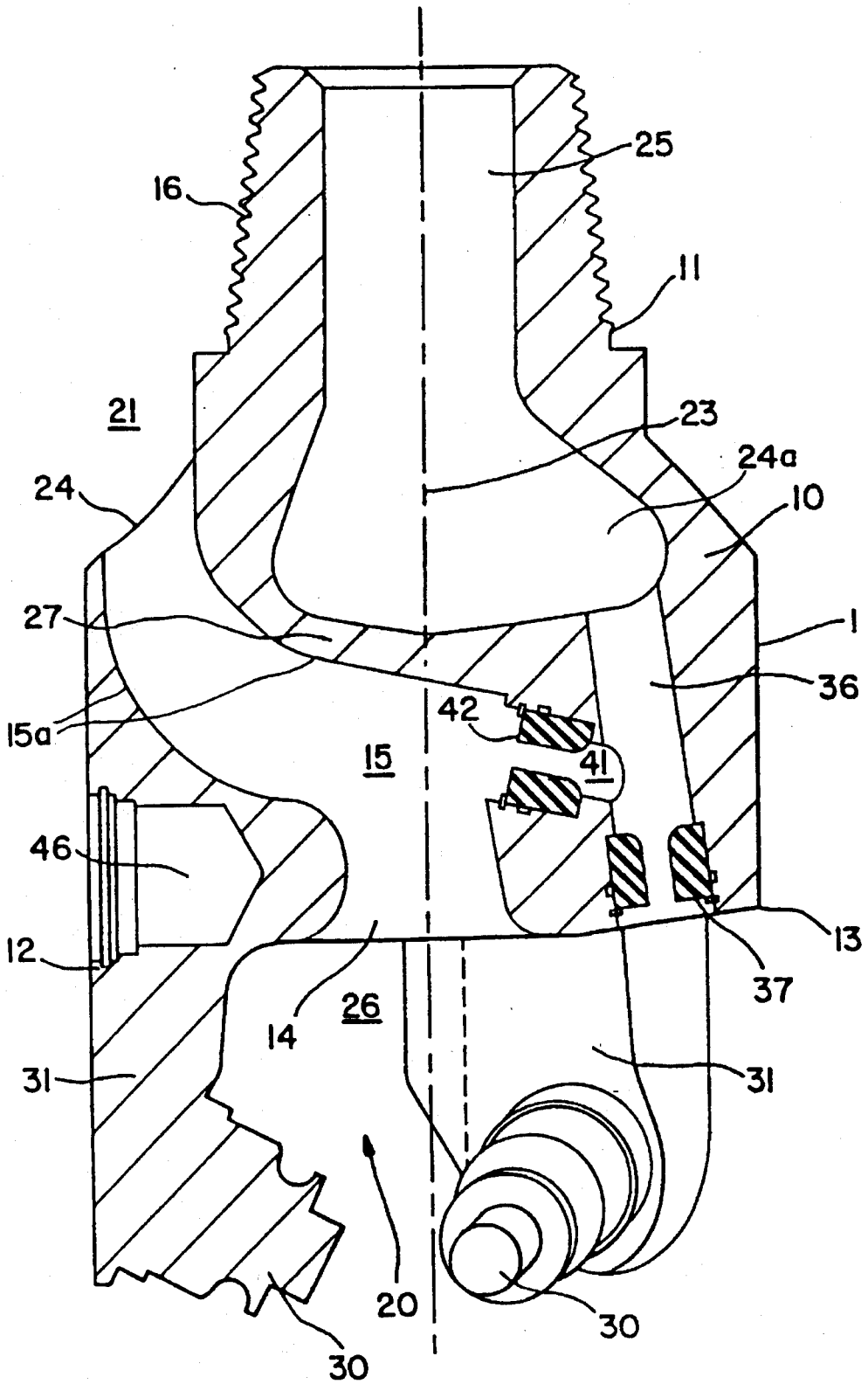
FIG. 3 is a sectional view of a cutter bit made in accordance with a third embodiment of the invention.

FIG. 3 shows a further embodiment of the invention in which the flow of cuttings through first passage 15 is enhanced by jetting of drilling fluids upward through the first passage 15 to create a venturi effect that further assists in cuttings removal from the first zone 20. In this embodiment, the conduit 36 communicates through conduit 41 and nozzle 42 with the first passage 15 thereby ensuring flow of drilling fluids into the first passage. Control over jetting velocity can be obtained by suitable sizing of the conduit 41 and nozzle 42. The trajectory of the jet is preferably angularly upward and in the embodiment shown is at 75° to the central axis 23 of the central bore 25 of the cutter bit 1. Although in the embodiment described only one such jet has been provided there could be provided a plurality of such jets to further enhance cuttings removal and hole cleaning.

It is of some importance in this embodiment that the first passage 15 be designed to avoid erosion damage caused by impingement of high velocity drilling fluids on the walls 15a of the passage. With this end in view, hard facing of a portion of the first passage 15 may be required.

Figure 4:
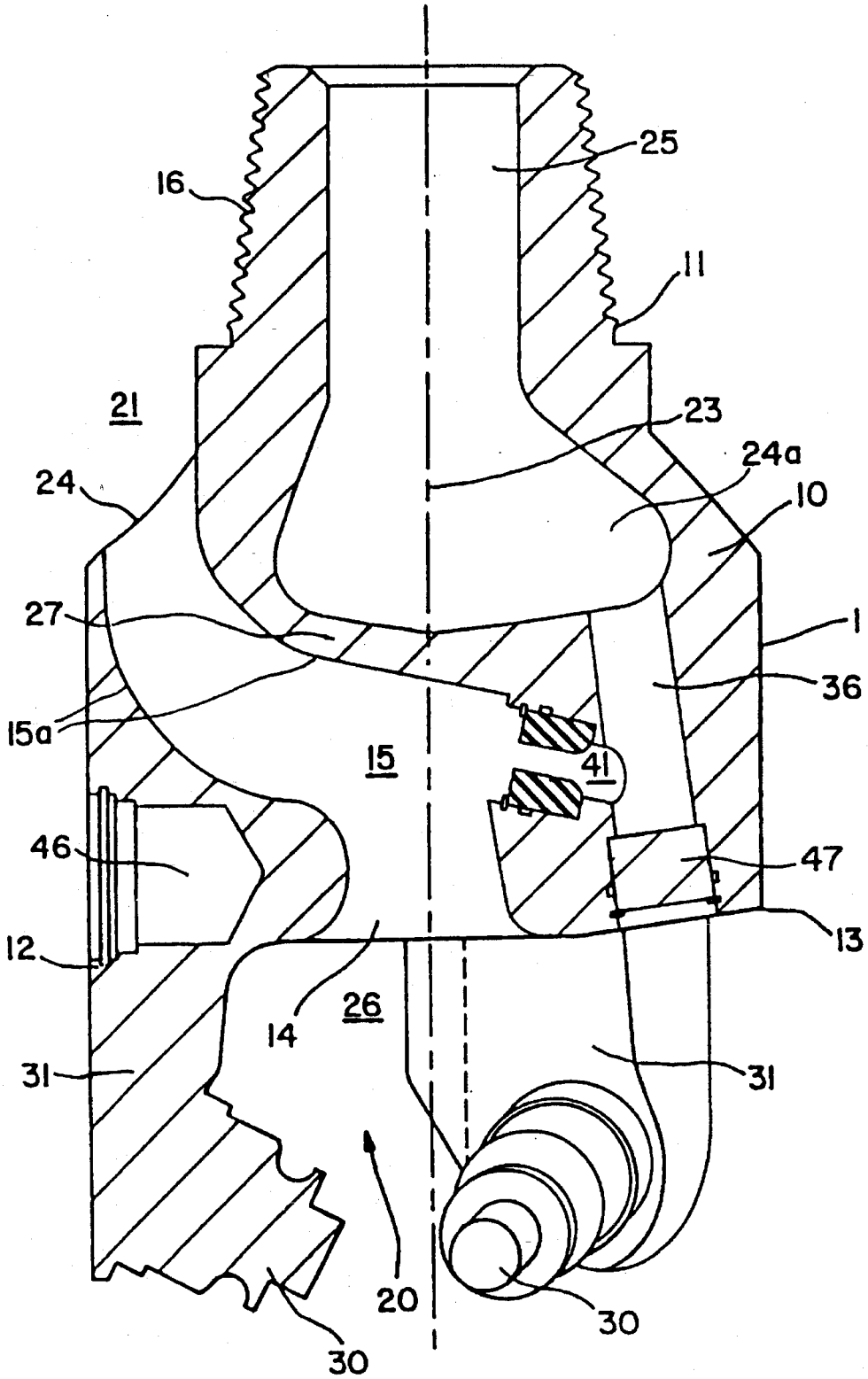
FIG. 4 is a sectional view of a cutter bit made in accordance with a fourth embodiment of the invention.

FIG. 4 shows a still further embodiment of the invention which is identical in many respects to that of FIG. 3 described above. However, in this embodiment, the nozzle 37 is absent with conduit 36 being blanked off by blank 47 at the position previously occupied by nozzle 37. Therefore, a jet of higher pressure through conduit 41 and nozzle 42 can be achieved. This facilitates removal of cuttings through the first passage 15 to the surface of the hole.

Figure 5:
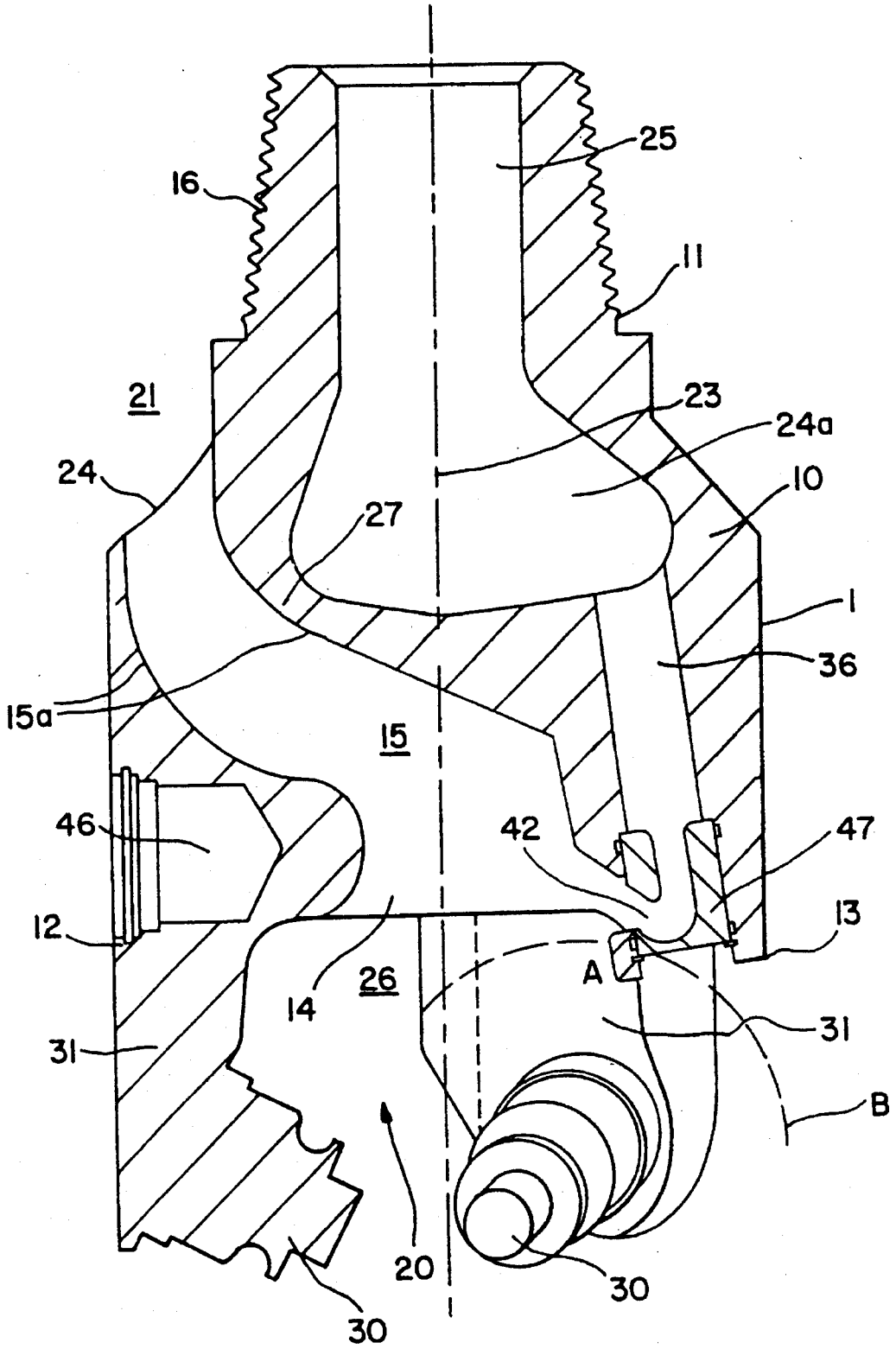
FIG. 5 is a sectional view of a cutter bit made in accordance with a fifth embodiment of the invention.

FIG. 5 shows a still further embodiment in which conduit 36 extends downwardly a sufficient distance that the nozzle 42 is located to cause a jet of drilling fluid above and adjacent, preferably immediately adjacent, the uppermost point, A, of the path of rotation, B, of each cutter element (not shown). The jet is directed along the trajectory of the first passage 15 to obtain the above described advantages.

There are also additional advantages to the arrangement shown in FIG. 5. Firstly, by extending the nozzles of the bit closer to the bottom of the hole and orientating the jets across the recess 26, jetting of the drilling fluid achieves a valuable cleaning effect which assists in the alleviation of bailing-up or accumulation of cuttings between the cone teeth or inserts of the cutter elements.

Secondly, and importantly, the location of nozzle 42 is in close proximity to a cutting face to which the cutter bit is exposed. As the jet of drilling fluid is directed along passage 15 or approximately tangential to the path of rotation, A, a venturi effect is obtained, creating a suction pressure at the cutting face which greatly assists hole cleaning.

Using one, two or three such jets at the above described position and orientation will create a reduced bottom hole pressure under the bit. This jetting action produces a venturi effect under the bit such that the reduced bottom hole pressures allow formation of an artificial drilling break.

Lower pressures at the bottom of the hole are desirable in that hole pore pressures and bottom hole pressure become equalised which is desirable at the bit tooth and rock contact. Consequently, the "chip hold down" which is always greater when drilling with heavier mud weights can also be reduced allowing for an equally substantial increase in the rate of penetration.

It is to be understood that the invention is in no way limited by the foregoing description and different means of effecting the invention may be apparent to those skilled in the art who have read the above description. For example, the invention is not limited in its application to three cone cutter bits. Such differences, however, do not depart from the scope of the invention.

The claims defining the invention are as follows:

1. A rotary drilling bit comprising:

(a) a body having (i) a threaded end adapted to be connected to a rotary tubular drill string and (ii) an inlet opening extending through the threaded end, said body having a full diameter lower body portion and an upper body portion which has at least a circumferential segment which is positioned radially inwardly with respect to the axis of rotation of the drill string and the bit connected thereto;

(b) a plurality of leg members extending downwardly from the periphery of the lower body portion and circumferentially spaced thereon whereby upon rotation of the bit the legs circumscribe a zone therebetween below the lower body portion;

(c) a cutting element mounted on each leg and extending inwardly into the zone;

(d) a supply flow passage extending through the body and interconnecting the bit inlet opening and the zone for delivering fluid to said zone; and (e) an interior return flow passage extending upwardly through the lower body portion from said zone and exiting upwardly from the lower body portion opposite the circumferential segment of the upper body portion whereby a portion at least of the fluid delivered from the supply flow passage to said zone flows from said zone through the return flow passage in the body, bypassing the exterior of the lower body portion.

2. The drilling bit according to claim 1 wherein the upper body portion and the lower body portion are inter-connected by a frustoconical section and wherein the return flow passage exits in the frustoconical section.

3. The drilling bit of claim 2 wherein the return flow passage is shaped to discharge flow therethrough in an upward direction generally parallel to the axis of rotation of the drill string.

4. The drilling bit according to claim 3 wherein the bit further comprises at least one additional return flow passage, each return flow passage having an outlet formed in the frustoconical section and circumferentially spaced from each other.

5. The drilling bit according to claim 1 and further comprising a nozzle mounted in the supply flow passage for creating a downward jetting action.

6. The drilling bit according to claim 5 and further comprising a bypass flow passage formed in the lower body portion and interconnecting the return flow passage upstream of the nozzle mounted in the supply flow passage and the return flow passage, said bypass flow passage having a nozzle mounted therein and being directed to discharge fluid directly into the return flow passage thereby assisting flow therethrough.

7. A rotary drilling bit comprising:

(a) a body having (i) a threaded end adapted to be connected to a rotary tubular drill string and (ii) an inlet opening extending through the threaded end, said body having a full diameter lower body portion and an upper portion which has at least a circumferential segment which is positioned radially inwardly with respect to the axis of rotation of the drill string and bit connected thereto;

(b) three leg members extending downwardly from the periphery of the full diameter lower body portion and circumferentially spaced thereon whereby upon rotation of the bit the legs circumscribe a zone below the lower body portion;

(c) a rotary cutting element journaled on each leg and extending inwardly into the zone;

(d) a port formed in the lower body portion for each cutting element and containing lubricant for lubricating each cutting element;

(e) first, second, and third supply flow passages extending through the body, each flow passage inter-connecting the bit inlet opening and the zone at circumferentially spaced locations for delivering fluid to said zone, each flow passage having a nozzle mounted thereon and directed to discharge into the zone proximate a cutting element; and (f) first, second, and third interior return flow passages extending upwardly through the lower body portion from said zone, each return flow passage exiting generally upwardly from the lower body portion opposite the circumferential segment whereby a portion at least of the fluid delivered from the supply flow passage to said zone flows from said zone through the return flow passages in the lower body portion, bypassing the exterior of the lower body portion.

8. The drilling bit according to claim 7 and further comprising first, second, and third bypass flow passages formed in the lower body portion, and interconnecting the first, second, and third supply flow passages and the first, second, and third return flow passages, respectively, the first, second and third bypass flow passages each having a nozzle formed therein and being directed to discharge fluid directly into its associated return flow passage.

9. A rotary drilling bit comprising:

(a) a body having (i) a threaded end adapted to be connected to a rotary tubular drill string and (ii) an inlet opening extending through the threaded end, said body having a full diameter lower body portion and an upper body portion which has at least a circumferential segment which is positioned radially inwardly with respect to the axis of rotation of the drill string and the bit connected thereto;

(b) a plurality of leg members extending downwardly from the periphery of the lower body portion and circumferentially spaced thereon whereby upon rotation of the bit the legs circumscribe a zone below the lower body portion;

(c) a cutting element mounted on each leg and extending inwardly into the zone;

(d) an interior return flow passage extending upwardly through the lower body portion from said zone and exiting upwardly from the lower body portion opposite the circumferential segment of the upper body portion; and (e) a supply flow passage extending through the body and interconnecting the bit inlet opening and the return flow passage at a location above the zone to deliver fluid directly into the return flow passage, by-passing the zone, whereby a portion at least of the fluid delivered from the supply flow passage to the return flow passage bypasses the exterior of the lower body portion and the zone.

10. A rotary drilling bit comprising:

(a) a body having (i) a threaded end adapted to be connected to a rotary tubular drill string and (ii) an inlet opening extending through the threaded end, said body having a full diameter lower body portion and an upper body portion which has at least a circumferential segment which is positioned radially inwardly with respect to the axis of rotation of the drill string and the bit connected thereto;

(b) first, second, and third leg members extending downwardly from the periphery of the lower body portion and circumferentially spaced thereon whereby upon rotation of the bit the legs circumscribe a zone below the lower body portion;

(c) first, second, and third cutting element journaled to first, second, and third legs, respectively, and extending inwardly into the zone;

(d) first, second, and third supply flow passages extending through the body and each interconnecting the bit inlet opening and the zone at circumferentially spaced locations;

(e) an interior return flow passage extending upwardly through the lower body portion from said zone, and exiting upwardly from the lower body portion opposite the circumferential segment of the upper body portion; and (f) first, second, and third nozzles mounted in the first, second, and third supply flow passages, respectively, the first, second, and third nozzles each having an outlet directed to discharge fluid proximate the first, second, and third cutting elements, respectively, and directly into the return flow passage, bypassing the zone, whereby fluid discharging from the flow nozzles into the return flow passage assists in removing solids from the zone.

* * * * *